US005355669A

United States Patent [19]

Karhu

[11] Patent Number: 5,355,669

[45] Date of Patent: Oct. 18, 1994

[54] APPARATUS AND METHOD FOR SIMULTANEOUS REVERSE STRANDING AND LONGITUDINAL STRIP WINDING OF CABLES

[75] Inventor: Raimo Karhu, Helsinki, Finland

[73] Assignee: Nokia-Maillefer Holding S.A., Ecublens, Switzerland

[21] Appl. No.: 929,910

[22] Filed: Aug. 17, 1992

[30] Foreign Application Priority Data

Aug. 28, 1991 [FI] Finland ..... 914068

[51] Int. Cl.[5] ..... H01B 13/02

[52] U.S. Cl. ..... 57/294; 57/293; 57/314

[58] Field of Search ..... 57/293, 294, 314, 204, 57/205, 31, 32, 235, 259, 260

[56] References Cited

U.S. PATENT DOCUMENTS

| | | | |
|---|---|---|---|
| 3,460,334 | 8/1969 | Lawrenson et al. | 57/293 |
| 4,166,355 | 9/1979 | Gross | 57/260 X |
| 4,385,485 | 5/1983 | Yonechi | 57/314 X |
| 4,386,496 | 6/1983 | Oestreich | 57/293 |
| 4,428,787 | 1/1984 | Pan et al. | 156/54 |
| 4,813,233 | 3/1989 | Nipper et al. | 57/314 X |
| 4,974,408 | 12/1990 | Karhu | 57/294 |

FOREIGN PATENT DOCUMENTS 2120836 12/1983 United Kingdom .

*Primary Examiner*—Daniel P. Stodola
*Assistant Examiner*—William Stryjewski
*Attorney, Agent, or Firm*—Nixon & Vanderhye

[57] ABSTRACT

A method and an arrangement in connection with reverse stranding, comprising drawing conductors through a stationary divider, peripheral tubes peripherically surrounding a central tube and twistable around the central tube recurrently in opposite directions and a twisting device rotatable in opposite directions, into a stranding nozzle or similar. To achieve longitudinal strip winding, a strip is fed into the central tube. The strip is guided to pass through the rotatable twisting device and further between the desired conductors ahead of the stranding nozzle or similar, the stranding nozzle or similar bending the edges of the strip in the desired direction.

6 Claims, 1 Drawing Sheet

APPARATUS AND METHOD FOR SIMULTANEOUS REVERSE STRANDING AND LONGITUDINAL STRIP WINDING OF CABLES

BACKGROUND OF THE INVENTION

A method in connection with reverse stranding, comprising drawing conductors, such as filaments, conductor elements, bundles of conductors, optical fibers or the like, of a cable to be produced, particularly of a block-insulated cable, through a stationary divider means, peripheral tubes peripherally surrounding a central tube and twistable around the central tube recurrently in opposite directions and a twisting means rotatable in opposite directions, into a stranding nozzle or similar. The invention also relates to an arrangement in connection with reverse stranding.

A wide variety of methods and arrangements are known in connection with reverse stranding. The solution disclosed in U.S. Pat. No. 4,974,408 may be mentioned as an example of such prior art solutions. The solution disclosed in this U.S. patent operates completely faultlessly in most circumstances, but if one desires to manufacture block-insulated cables, PCM cables for instance, by means of such an arrangement, then said solution cannot be used as such, as the feed of a strip serving as an intermediate shield in the cable cannot be realized with said apparatus. The block-insulated cables referred to above are digital cables usually employed for duplex data transmission, and therefore the discrete main blocks are separated from one another by an S-shaped metallic intermediate shield. The intent is to correct near-end crosstalk, since both transmission directions use the same frequency band and, furthermore, the difference in level between the output and input is great.

Several different solutions have been developed for the longitudinal strip winding of a block-insulated cable. The solution described in U.S. Pat. No. 4,428,787 may be mentioned as an example of an arrangement for longitudinal strip winding known in this field. The solution of this U.S. patent is intended only and exclusively for carrying out longitudinal strip winding; for instance stranding cannot be performed by means of this arrangement.

The drawback of the prior art has been the large quantity of devices required in the manufacture of cables of the above type. Heretofore it has not been possible to perform reverse stranding and longitudinal strip winding with the same equipment. Furthermore, it has been difficult to connect the strip winding to other steps. This has increased the costs and complicated the production.

SUMMARY OF THE INVENTION

It is the object of the invention to provide a method and an arrangement wherewith the drawbacks of the prior art can be eliminated. This has been achieved with the method of the invention, which is characterized in that a strip is fed into the central tube, the strip is guided to pass through the rotatable twisting means and further between the desired conductors ahead of the stranding nozzle or similar, the stranding nozzle or similar bending the edges of the strip which serves as an intermediate shield in the cable in the desired direction. The arrangement of the invention is again characterized in that it comprises means for feeding a strip which serves as an intermediate shield into a central tube, a slotted twisting member disposed in connection with a rotatable twisting means and a rotatable stranding nozzle or similar, the slotted member being adapted to guide the strip between the desired conductors ahead of the rotatable stranding nozzle or similar.

The advantage of the invention lies above all in that the strip winding, stranding and binding can be combined in a second line, for instance a sheathing line. A further advantage is that the strips can be continued with a tape paster during the run, or the run can be performed with continued strip coils joined together in a separate step. A further advantage is that on account of prolonged upturns, a combined stranding, strip winding and binding speed would permit higher line speeds than is typically permitted by the output of the plastic press. Still another advantage of the invention is its simplicity and suitability for use in connection with existing equipment. Thus putting the invention into use is advantageous.

BRIEF DESCRIPTION OF THE DRAWING FIGURES

Preferred embodiments of the invention will now be described, by way of example, with reference to the accompanying drawing in which FIG. 1 is an example of a typical PCM cable in a schematic perspective view, FIG. 2 is a schematic elevational view of the arrangement of the invention, FIG. 3 is a schematic elevational sectional view of the passage of the strip within the central tube, and FIGS. 4, 5 and 6 show alternative embodiments of an essential detail of the arrangement of FIG. 2 in views seen in the running direction of the strip.

DESCRIPTION OF A PREFERRED EMBODIMENT

Figure 1:
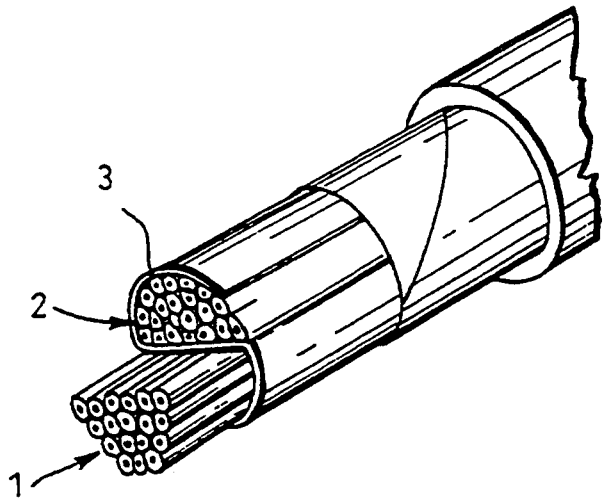
FIG. 1 (PRIOR ART)
FIG. 1 is a schematic representation of an example of a block-insulated cable, wherein the individual main blocks 1, 2 are separated from one another by an S-shaped metallic intermediate shield 3.

FIG. 1 shows a preferred embodiment of the arrangement of the invention. The embodiments of this figure include a stationary divider means 5 disposed at the upstream end for the conductors 4 to be stranded with said arrangement, a twisting means 6 disposed at the downstream end, and a medially disposed central tube 7 rotatable recurrently about its longitudinal axis in opposite directions and peripheral tubes 8 being twistable recurrently in opposite directions and peripherally surrounding the central tube 7, the central tube and the peripheral tubes being disposed between the divider means and the twisting means. The central tube 7 and the peripheral tubes 8 are pressed against each other at least during the twisting step of the conductors, and the conductors 4 are adapted to pass through the peripheral tubes 8 and a strip 12 is adapted to pass through the central tube 7. The term conductor in this context refers to filaments, conductor elements, bundles of conductors, quads, optical fibers and other similar elements.

Figure 2:
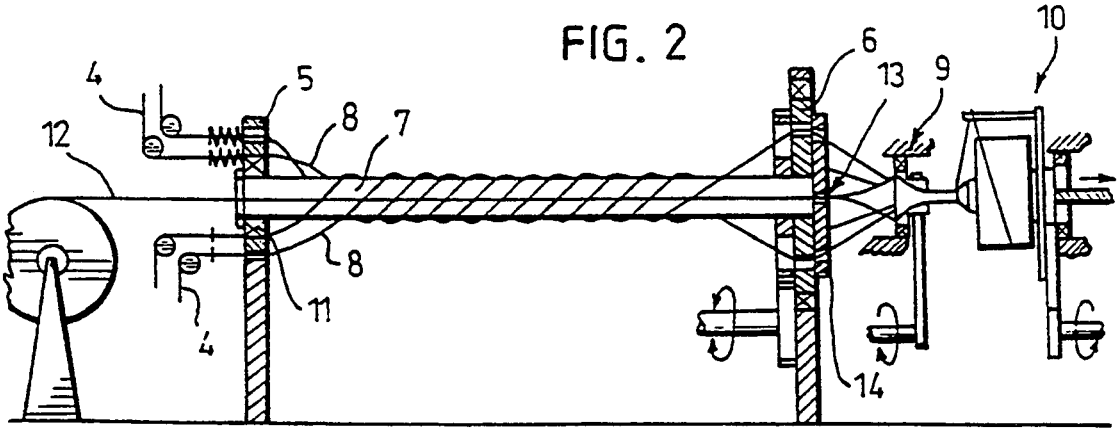
FIG. 2 is a schematic representation of an arrangement in accordance with the invention, wherewith block-insulated cable can be produced in a simple way.

When a reverse-stranded product is manufactured with the apparatus of FIG. 2, the conductors to be stranded are drawn through the divider means 5 into the peripheral tubes 8 and further through the twisting means 6 out for instance into a stranding nozzle 9 disposed downstream of the twisting means in the running direction of the conductors, the nozzle having a tapering opening wherein the stranded conductors are pressed tightly against one another, thus forming a reverse-stranded product. Any conventional binding device or other similar apparatus 10 may be used for the binding.

The divider means and the twisting means may be for instance apertured disks, each having a central bore for the central tube 7 and a plurality of bores, peripherally spaced at regular intervals and radially distanced from the central bore, for the peripheral tubes 8 and for the stranded conductors 4 to be drawn through the peripheral tubes. The stationary divider means 5 at the upstream end for the conductors is fixedly secured to the support structure of the reverse stranding apparatus, and the twisting means 6 at the downstream end for the conductors is journalled to the support structure of the reverse stranding apparatus. The twisting means 6 is fitted with a rotatable drive of its own, preferably with a chain gear, gear transmission, or cogged belt driven electric motor whose speed of rotation can be regulated and reversing automation realized relatively simply.

The peripheral tubes 8 may be formed from thin tubes made from a torsion-elastic material, said tubes being attached to the bores of both the divider means 5 and the twisting means 6, so that the tubes form a tube sheath around the central tube 7. The peripheral tubes may be manufactured from polyamide or polytetrafluoroethylene, for instance.

During the twisting step of the conductors 4 to be stranded, the peripheral tubes 8 are twisted to the external surface of the central tube 7 on account of the rotating motion of the twisting means 6. To compensate the increasing tensile stress generated by the twisting of the peripheral tubes, the ends of the peripheral tubes are secured to at least the bores of the divider means 5 in an axially resilient manner. Furthermore, it is expedient to bind the peripheral tubes elastically with one another, which eliminates the drawbacks of centrifugal force. The structural details relating to peripheral tubes have been described in U.S. Pat. No. 4,974,408, for instance.

In the embodiment of FIG. 2, the upstream end of the central tube 7 has been fitted in the central bore of the stationary divider means 5 as a part rotatable relative to said divider means, and fitted with a journalling 11 withstanding axial loads. The downstream end is rigidly secured to the central bore of the twisting means 6. In this embodiment, the rotating and twisting movements of the central tube 7 and the peripheral tubes 8 are generated by the twisting means 6.

The central tube may be manufactured for instance from steel, but it should be noted that steel is not the only possible material, since the central tube may also be a torsion-elastic tube manufactured from a plastic material.

The construction and operation of the central tubes have been described in U.S. Pat. No. 4,974,408, for instance. This patent also otherwise discloses technology relating to reverse stranding apparatus, wherefore it is incorporated herein by reference.

In accordance with an essential feature of the invention, a strip 12 serving as an intermediate shield 2 separating the main blocks in a completed cable as shown in the example of FIG. 1 is fed into the central tube 7. The strip 12 is guided to pass through the rotatable twisting means 6 and is further guided between the desired conductors 4 ahead of the stranding nozzle or similar 9. In accordance with the invention, the stranding nozzle or similar 9 bends the edges of the strip 12 in the desired direction.

Thus, by means of the invention the stranding and longitudinal strip winding of the main blocks can be combined, so that the middle portion of the S remains between the main blocks and the edges thereof are bent around them invariably in the same direction.

The strip types used may be paper, plastic or metal strips or combinations thereof. The strip payoffs may be braked coils, several of which may be disposed adjacently on one shaft. The strips on the coils are Joined together: when one is finished the strip will shift to an adjacent coil. In the case of large-diameter coils, driven pay-offs are used.

The strip 12 is guided from the pay-off into the central tube 7, as set forth previously. The diameter of the central tube is equal to or greater than the width of the strip 12. In some cases, the strip can be bent preliminarily into the shape of an S or a V, thus enabling the use of a smaller-diameter central tube 7. The diameter of the central tube is greater that the diameters of the peripheral tubes.

Figure 4:
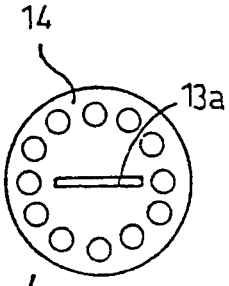
Figure 5:
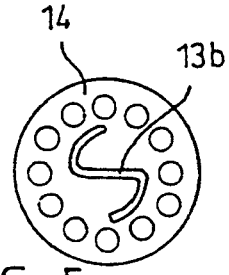
Figure 6:
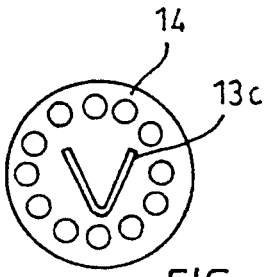

As stated previously, the strip 12 is guided between the desired blocks, i.e. bundles constituted by conductors 4, ahead of the stranding nozzle or similar 9. The guiding is effected by means of a slot 13 provided in connection with the rotatable twisting means 6. The slot 13 may be provided for instance in a wearing plate 14 fixed to the rotatable twisting means 6. FIGS. 4 to 6 show some possible shapes for the slot. Thus the slot 13 may have a wide variety of configurations. In FIGS. 4 to 6, the different variants of the slot are indicated by the reference numerals 13*a*, 13*b* and 13*c*.

Figure 3:
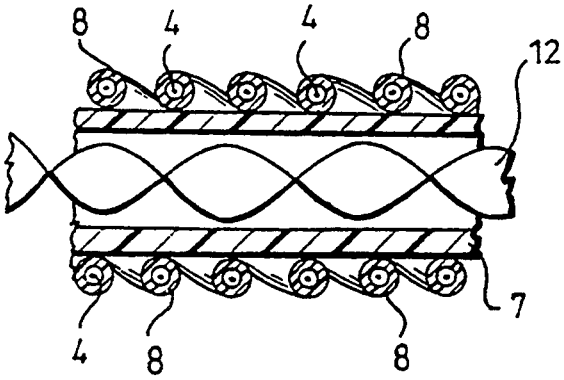

Reverse stranding, for instance SZ stranding, inherently involves reciprocating rotation of the twisting means 6, and in consequence the strip 12 will also be twisted up to the guides at the pay-off. The twisting of the strip 12 takes place protected within the central tube 7, as shown in FIG. 3. On account of the length of the tube packet, there is a sufficient reserve length maintaining the pitch of twist of the strip 12 sufficiently high.

The rotatable stranding nozzle 9 may be a separate device disposed for instance ahead of the binding device 10. However, the strip winding, stranding and binding may also be performed in a rotatable nozzle of the binding device 10. While rotating, the stranding nozzle 9 bends the edges of the strip 12 passing therethrough in the desired direction. Consequent upon the SZ stranding mode, the speed of rotation of the stranding nozzle 9 must always be higher than the speed of rotation of the rotatable twisting means 6.

The examples set forth above are in no way intended to restrict the invention, but the invention may be modified fully freely within the scope of the claims. Thus it is to be understood that the arrangement of the invention or its details need not necessarily be exactly as shown in the figures, but other solutions are possible as well. For instance, the number of peripheral tubes may be selected in accordance with current need, etc. The stranding nozzle and the twirling member of the binding device may be rotated by any suitable power source, and any suitable transmission mechanism may also be used in these details. Any suitable reel arrangements, and also power sources in some embodiments, may be used as strip feeding means, as stated previously. Also the slot may be shaped at will in accordance with current need.

I claim:

1. A method of forming a cable by reverse stranding and longitudinal strip winding comprising the steps of:

drawing conductors in a downstream direction through a stationary divider means, peripheral tubes surrounding a central tube and twistable around the central tube recurrently in opposite directions and a twisting device rotatable in opposite directions, into a stranding nozzle;

rotating the twisting device in opposite directions;

feeding a longitudinally extending strip into the central tube in a downstream direction;

guiding the strip through the rotatable twisting device and between the conductors upstream of the stranding nozzle to twist the strip in opposite directions upon rotation of the twisting device in opposite directions; and subsequent to guiding and twisting the strip, bending the edges of the strip to serve as an intermediate shield among the conductors in the cable.

2. A method according to claim 1 including providing a slot in the rotatable twisting device and guiding the strip between the conductors by means of the slot.

3. A method according to claim 1 including rotating the stranding nozzle and at a higher speed than the speed of rotation of the twisting device.

4. Apparatus for forming a cable comprising a stationary divider means disposed at an upstream end of conductors to be stranded to form a cable, a twisting device rotatable in opposite directions and disposed at a downstream end of the conductors to be stranded, and a centrally disposed tube rotatable recurrently about its longitudinal axis in opposite directions, peripheral tubes peripherally surrounding the central tube and twistable recurrently in opposite directions, the central tube and the peripheral tubes being disposed between the divider means and the twisting device and bearing against one another during twisting of the conductors, the conductors to be stranded being adapted to pass through said peripheral tubes, means for feeding a rectilinear strip for use as an intermediate shield into said central tube, a twisting member carried by said twisting device and having a slot, and a rotatable stranding nozzle, said member being rotatable with said twisting means in opposite directions and being located to twist and guide the strip between the conductors upstream of the rotatable stranding nozzle to segregate groups of conductors on opposite sides of said strip in said cable.

5. An arrangement as claimed in claim 4 wherein the member has a wear plate secured to said twisting device.

6. An arrangement as claimed in claim 4 wherein said stranding nozzle is rotatable and at a speed higher than the speed of rotation of said twisting device.

* * * * *